US005490458A

United States Patent [19]

Stuart

[11] Patent Number: 5,490,458

[45] Date of Patent: Feb. 13, 1996

[54] PRINTING PRESS CYLINDER ASSEMBLY

[75] Inventor: Warner H. Stuart, Thatcher, Id.

[73] Assignee: Bryce Corporation, Memphis, Tenn.

[21] Appl. No.: 227,048

[22] Filed: Apr. 13, 1994

[51] Int. Cl.[6] ..... B41F 13/10

[52] U.S. Cl. ..... 101/375; 492/47

[58] Field of Search ..... 101/375, 376, 101/216, 212, 152, 153, 213, 136, 141, 174, 205, 206, 328, 348, 349; 492/21, 39, 45, 47, 60, 15, 28

[56] References Cited

U.S. PATENT DOCUMENTS

| | | | |
|---|---|---|---|
| 763,251 | 6/1904 | Breck | 101/375 |
| 776,796 | 12/1904 | Perkins | 492/45 |
| 796,212 | 8/1905 | Horsell | 101/348 |
| 1,008,507 | 11/1911 | Wheat . | |
| 1,172,907 | 2/1916 | Rust | 492/45 |
| 1,200,524 | 10/1916 | Roesen . | |
| 1,518,836 | 12/1924 | Casel | 492/47 |
| 1,582,453 | 4/1926 | Dustan . | |
| 1,802,003 | 4/1931 | Connelly . | |
| 1,891,405 | 12/1932 | Ericksson . | |
| 1,995,973 | 3/1935 | Ericksson | 101/401.1 |
| 2,072,297 | 3/1937 | Damm | 101/375 |
| 2,315,729 | 4/1943 | Nunnally | 101/375 |
| 2,587,606 | 3/1952 | Dungler | 101/248 |
| 2,801,584 | 8/1957 | Davidson | 101/216 |
| 2,918,867 | 12/1959 | Killary et al. | 101/375 |
| 2,925,037 | 2/1960 | Fischer | 101/216 |
| 3,173,361 | 3/1965 | Verlik | 101/216 |
| 3,205,814 | 9/1965 | Huck | 101/216 |
| 3,739,722 | 6/1973 | Zottoli | 101/375 |
| 3,783,780 | 1/1974 | Saueressig | 101/153 |
| 4,007,680 | 2/1977 | Pfleger et al. | 101/153 |
| 4,510,865 | 4/1985 | Molinatio | 101/375 |
| 4,901,641 | 2/1990 | Steiner et al. | 101/152 |
| 4,913,048 | 4/1990 | Tittgemeyer | 101/141 |
| 5,174,207 | 12/1992 | Wallman | 101/216 |
| 5,177,867 | 1/1993 | Danielsson | 492/45 |
| 5,216,953 | 6/1993 | Hada | 101/375 |

FOREIGN PATENT DOCUMENTS

| | | | |
|---|---|---|---|
| 1045351 | 11/1953 | France | 492/47 |
| 1327229 | 4/1963 | France | 492/47 |

*Primary Examiner*—Eugene H. Eickholt
*Attorney, Agent, or Firm*—Luedeka, Neely & Graham

[57] ABSTRACT

A printing cylinder assembly comprises a cylinder shell with opposite open ends. Cylinder heads are received into the opposite open ends of the shell and include stub axle shafts which project outwardly in opposite directions. The shell open ends are reinforced by collet rings having an internally tapered collet face matched to receive a correspondingly tapered face on the cylinder heads. The opposite axle shafts are both bored coaxially to receive an end-to-end drawbolt. Internally, the cylinder heads have a sleeved socket to receive one end of respective graphite fiber tubes. At opposite ends, the graphite tubes are terminated into respective pin and socket joints. In assembly, the cylinder heads are faced to the sleeve collets with the graphite tube pin and socket joints meshed. The drawbolt is inserted along the axis length of the assembly and drawn tight by washer-nut fasteners.

22 Claims, 1 Drawing Sheet

PRINTING PRESS CYLINDER ASSEMBLY

BACKGROUND OF THE INVENTION

The present invention relates to rotogravure printing and particularly to the construction and fabrication of printing cylinder assemblies for rotogravure printing.

Rotogravure printing machines generally include one or more image cylinders rotatively driven in nip association with respective platten cylinders. Ink doctored upon the image cylinder surface is applied to the surface of a web or film as the web passes between the ink laden image cylinder surface and the platten surface.

Image cylinder surfaces are created by a number of methods including photo etched rubber or elastomer plates that are wrapped around the perimeter of a structural cylinder surface and bonded in place. Alternatively, an image may be etched into the surface of a metallic shell which is slipped into place axially over a structural carrier cylinder. Additionally, an image may be etched into the surface of a structural cylindrical shell which is secured coaxially about an axle.

Regardless of how an ink transfer image is associated with a rotating cylinder structure, that structure will be supported between axially aligned journals or bearings. Usually, this support will take the form of a solid steel journal shaft or core element which is passed through a structural image cylinder. Such cylinder assemblies are expensive to make and difficult to use, often requiring two or more workmen with hoisting machinery to move and mount the assemblies in the machine frame. Also, the existing structure of print cylinder assemblies does not readily allow print cylinders to be interchanged between different width presses.

It is, therefore, an object of the present invention to provide a print cylinder assembly for rotogravure printing machines.

It is another object of the invention to provide a rotogravure printing cylinder assembly having a materially reduced installation weight.

Another object of the present invention is to provide a print cylinder assembly which permits the same gravure cylinder to be used on different width presses.

Still another object of the present invention is to provide a versatile, lightweight print cylinder assembly which is simple to make and use.

A further object of the present invention is to reduce the storage area required in a rotary printing facility for a given number of cylinders.

An additional object of the present invention is to reduce the inventory of cylinders for a given rotary printing operation using various size presses.

Yet another object of the present invention is to reduce the unit cost of rotary printing press cylinder assemblies.

SUMMARY

Having regard for the foregoing and other objects, the present invention is directed to a rotary printing press image cylinder assembly which comprises a hollow, elongate open-ended cylindrical shell having a center length axis extending along its length. Cylinder heads are disposed adjacent each of the open ends of the cylindrical shell and elongate stub axles project outwardly from each of the cylinder heads substantially coaxially with the center length axis of the cylindrical shell. The shell has conical bearing surfaces on its open ends which mate with conical bearing surfaces on the cylinder heads to provide a conical bearing surface interface between the cylinder heads and the shell to limit entry of the cylinder heads into the shell and to maintain the stub axles in their substantially coaxial relationship with respect to the center length axis of the cylindrical shell. An elongate alignment tube projects inwardly from each of the cylinder heads into the cylindrical shell substantially coaxially with the center length axis of the shell. The alignment tubes are connected together so as to enable relative longitudinal movement therebetween while restricting off-axis movement of the alignment tubes with respect to one another and the length axis. Means are provided for urging the cylinder heads inwardly against the cylinder shell so that the cylinder shell is axially compressed between the cylinder heads to provide the conical bearing surface interface. The connection between the alignment tubes and the conical bearing surface interfaces cooperate to restrict off-axis movement of the alignment tubes and their associated cylinder heads and stub axles with respect to each other and the center length axis of the cylindrical shell. In a preferred embodiment, the alignment tubes are fabricated of a carbon fiber composite.

Overall, the invention provides a lightweight printing cylinder assembly which enables the use of a cylinder shell on varying width presses through the use of cylinder heads with different length stub axles. The structure of the assembly is relatively uncomplicated in design and provides interchangeability of cylinder shells in an assembly which is considerably simpler and easier to use than existing printing cylinder assemblies.

In one embodiment, the conical bearing surfaces on the cylinder shells are provided by collet rings set in the open ends of the shell for structural reinforcement. Conical faces on the internal perimeter of the collet rings receive the corresponding conical faces on the circular outside perimeter of cylinder heads. Projecting coaxially from each of the cylinder head interiors is an integral, circular sleeve. Seated within the inside bore of the sleeves are the alignment tubes. At the distal end of the tubes is, on one tube, a hardened steel socket bushing which serves as a pin socket. The other tube distal end is provided with a hardened steel pin. The pin outside diameter is ground to slidingly but tightly engage the ground inside diameter of the socket bushing. Projecting from each outer cylinder head surface is the stub axle shaft having a bored opening axially therethrough of sufficient diameter to receive a drawbar between opposite stub axle tips which aligns and clamps the entire assembly as rigid unit.

An image plate is secured to the surface of the structural shell or, if desired, an image may be etched or engraved into the outer surface of the structural shell.

DESCRIPTION OF THE DRAWINGS

The invention will be further understood from consideration of the following detailed description of a preferred embodiment in conjunction with the accompanying drawings in which.

PREFERRED EMBODIMENT

Figure 1:
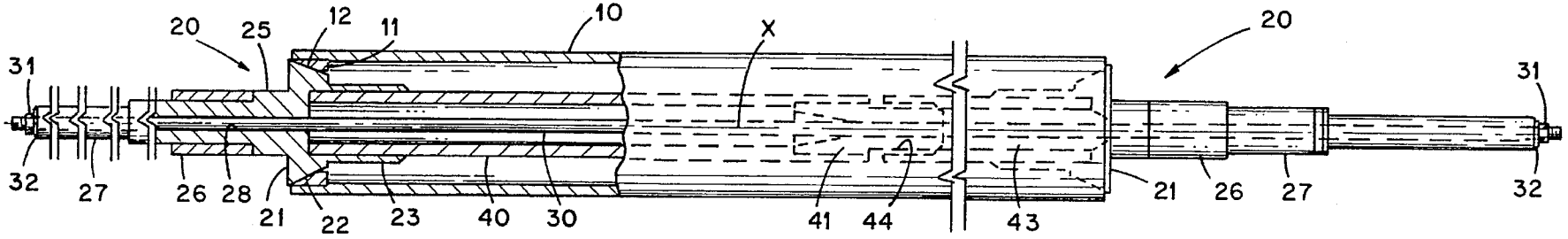
FIG. 1 is a partially sectional elevational view of a rotary printing cylinder assembly according to one embodiment of the present invention.
Figure 2:
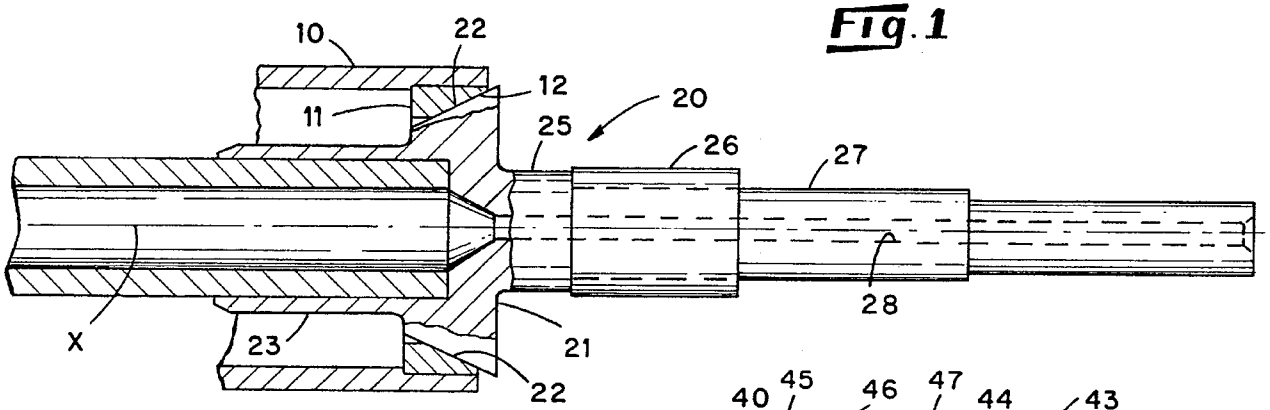
FIG. 2 is an enlarged, partially sectional view of one end of the cylinder assembly of FIG. 1; and, FIG. 3 is a sectional elevational view of a pin and socket joint between a pair of graphite axis tubes used in the print cylinder assembly of the invention.
Figure 3:
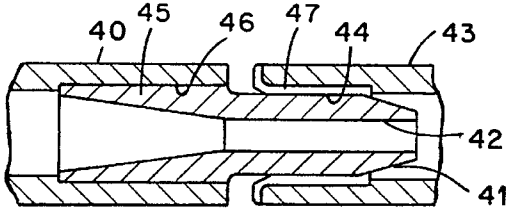

With reference now to the drawings in which like reference characters designate like or similar parts throughout the several views, a rotary print cylinder assembly is shown in FIG. 1 according to a preferred embodiment of the invention. The assembly includes a thin walled, open-ended cylindrical shell 10 which may be formed of many different materials including, but not limited to, steel, aluminum, copper and various alloys or any other material suitable for defining an image printing surface. A gravure image or pattern is formed in or secured to the exterior surface of the shell 10. In use, the shell 10 rotates about a center length axis X extending along its length.

Opposite open ends of the shell 10 are preferably counterbored to seat a structurally reinforcing steel collet ring 11. Of course, structural materials other than steel may be used to fabricate the collet ring 11 such as brass, bronze, aluminum or cast iron. The ring 11 preferably has an outwardly biased conical seating or bearing face 12. Alternately, the cylinder shell 10 may be directly formed with a conical bearing surface. The surface preferably makes an angle of about 25° with respect to length axis X.

At respective ends of the shell 10 are substantially identical, integral stub axle units 20 comprising a cylinder head 21, an internal tube sleeve 23, a stub arbor 25 and an external axle pin 27. The integral stub units 20 are preferably formed from appropriate high strength steel, suitably heat treated and critical surfaces preferably ground to finished dimensions.

A tapered or conical seating or bearing face 22 respective to each head 21 mates internally with a respective conical collet seating face 12 to provide a conical bearing surface interface between the cylinder heads 21 and the shell 10 to limit movement of the heads 21 into the shell while restricting off-axis movement of heads 21 relative to the center length axis X. In some cases, it may be desirable to press a bearing race or journal sleeve 26 onto the axle stub arbor 25. An axial throughbore 28 is drilled along the length of each unit 20 to receive a continuous drawbolt 30 therethrough. The cylinder heads 21, tube sleeves 23, stub arbors 25, axle pins 27, throughbore 28 and drawbolt 30 are all preferably disposed coaxially with the center length axis X.

The tube sleeves 23 which project internally of head plugs 21 each receive one end of an elongate alignment tube 40 or 43, which are preferably fabricated of a graphite fiber composite. Graphite fiber materials are preferred for the tubes 40 and 43 due to their strength, light weight and stiffness due to a bending modulus greater than steel.

The distal or interior end of tube 40 is preferably terminated at about, but slightly short of, the shell 10 mid-length position. A hardened steel pin 41 is set in the end of the tube 40 with a sealing base 45, as by press-fitting and or adhesively bonding base 45 in a countersunk bore 46 in the end of the tube 40. The distal end of tube 43 is also preferably terminated at a length which disposes the open end of the tube 43 at about, but slightly less than the shell 10 mid-length. A small space in the order of about ⅜ in. may be provided to accommodate axial sliding of the tubes relative to one another as may occur in assembly or use.

A socket liner 44 is securely set in a countersunk bore 47 in the open end of the tube 43 as by press-fitting or by an additional bond. The internal surface of socket liner 44 is dimensioned to slidingly mate with the external surface of the pin 41 with a minimum or no radial clearance between the two.

An axial throughbore 42 along the length of pin 41 coaxially aligns with the graphite tube axes and the axle pin throughbore 28 to receive the continuous drawbolt 30 between the distal tips of opposite pins 27, providing along with the pin and socket joint a connection between the tubes 40 and 43 which limits off-axis movement of the tubes with respect to each other and the length axis X. The drawbolt 30 preferably has a diameter relative to that of the throughbores 42 and 28 (which are preferably substantially equal) which provides a close tolerance slip fit between the draw bolt and the pin 41 (and thus the interlocked tubes 40) and axle units 20. Washers 32 and nuts 31 thread upon the drawbolt 30 ends to compressively clamp the axle stub units 20 and cylinder shell 10 axially together against the tension of the drawbolt.

Although the illustrated embodiment includes nuts on both ends of the drawbolt 30, it is within the scope of the invention to use a long bolt tightened by only one nut against an opposite bolt head. Similarly, it is not essential to have throughbores 28 in both journal pins. Thus, a bolt may be inserted from one end through bore 28 and threaded into a threaded socket in the opposite end head 21.

It is to be noted, in particular, that the graphite tubes 40 and 43 advantageously carry little or no axially directed stress, either tensile or compressive, due to the sliding connection between the tube distal ends. The connection of the graphite tubes together with the conical bearing surface interface between cylinder heads 21 and shell 10 serves to maintain the operating coaxial alignment of the axle stub units 20 with the center length axis X without imposing unnecessary stress on the thin shell 10 end sections and to accommodate minor shell length variations respective to different shells in the plant inventory.

Cylinder unit drive torque is transmitted from a respective axle stub unit 20, which carries a drive gear (not shown), through the corresponding cylinder head 21 and across the tapered interface with the collet ring 11 and into the shell 10 structure. Nuts 31 threaded upon opposite ends of the drawbolt 30 and turned against washers 32 are torqued as required against each other to tension the drawbolt and opposingly compress the cylinder head bearing face 22 against the collet ring bearing face 12 thereby frictionally locking the juxtaposed tapered surfaces together as a singular, torque transmitting unit which rotatively drives the corresponding shell 10.

From the foregoing description, it will be appreciated that the axle stub units 20, which are distinctively sized to bearings and frame spacing of a particular machine press, are not necessarily distinctively related to a particular cylinder shell 10. Consequently, a given shell 10 may be disassembled from one set of axle stubs and stored as an independent structural element free of core weight, and the additional space required of dedicated axle stubs.

Moreover, as an assembled cylinder unit, the invention is unburdened by the weight penalty of a solid cylinder core or even a heavy shell thickness as would be required to withstand the end-buckling stress which may be imposed by the stub axles without the bending flexure control provided by the graphite tubes 40 and 43.

By standardized seat face 12 dimensions for all shell collets 11 in a plant inventory and a substantially uniform shell 10 length dimension, any shell in a plant inventory may be operated on any press having a corresponding stub axle set.

Those of ordinary skill in the rotary printing arts are aware of the importance axial concentricity has upon the print product quality of a rotary printing cylinder. With reasonable accuracy of individual component manufacture, the present invention assembly will maintain concentricity to within 0.0005 to 0.0001 in. eccentricity after repeated disassembles. This eccentricity is characterized as total indicated runout (TIR).

Having fully disclosed the preferred embodiment of my invention, those of ordinary skill in the art will perceive convenient alternatives and equivalents to the construction, fabrication assembly or operation of my invention as set forth in the appended claims

What is claimed:

1. A rotary printing cylinder assembly which comprises a hollow, elongate open-ended cylindrical shell having a center length axis extending along its length, cylinder heads disposed adjacent each of said open ends of said cylindrical shell, an elongate stub axle projecting outwardly from each cylinder head substantially co-axially of said center length axis of said cylindrical shell, said shell having conical bearing surfaces on its open ends which mate with conical bearing surfaces on said cylinder heads to provide a conical bearing surface interface between said cylinder heads and said shell to limit entry of said cylinder heads into said shell and to maintain said stub axles in said co-axial relationship with respect to said center length axis of said cylindrical shell, elongate alignment tubes projecting inwardly from each cylinder head and into said cylinder shell substantially co-axially with said center length axis of said cylindrical shell, connection means for connecting said alignment tubes together so as to enable relative longitudinal movement therebetween while restricting off-axis movement of said alignment tubes with respect to one another and said length axis, and engagement means for urging said cylinder heads inwardly against said cylinder shell so that said cylinder shell is axially compressed between said cylinder heads to provide said conical bearing surface interface, said connection means and said conical bearing surface interface cooperating when said shell is engaged between said cylinder heads to restrict off-axis movement of said alignment tubes and their associated cylinder heads and stub axles with respect to each other and said center axis.

2. The printing cylinder assembly of claim 1 wherein said cylinder heads and stub axles are integral so that an integral head and stub axle is disposed in each of said open ends of said cylindrical shell.

3. The printing cylinder assembly of claim 2, wherein said cylinder heads include inwardly projecting elongate sleeves and said alignment tubes are fixedly received into said sleeves.

4. The printing cylinder of claim 1 wherein said conical bearing surfaces on said cylinder shell are provided by collet rings located on said open ends of said cylinder shell concentrically disposed relative to said center axis of said cylinder shell.

5. The printing cylinder assembly of claim 1 wherein said connection means comprises an elongate pin projecting from one of said alignment tubes and an elongate socket located in the other of said alignment tubes wherein said socket fittingly receives said pin to accommodate sliding movement of said pin in said socket while restricting off-axis movement of said tubes with respect to each other and said center axis.

6. The printing assembly of claim 1 wherein said alignment tubes are fabricated of a carbon fiber composite material.

7. The printing cylinder assembly of claim 1 wherein said means for engaging comprises a throughbore extending through each of said cylinder heads, stub axles, connection means and alignment tubes and a drawbar disposed in said throughbore and connected between said stub axles in tension so as to axially compress said cylindrical shell between said cylinder heads.

8. A rotary printing cylinder assembly comprising shell means having opposite ends thereof, said shell means being secured about an elongated cylinder axis passing substantially normally through the center of substantially circular collet rings secured to said opposite ends of said shell means parallel with circular end planes respective said shell means, said collet rings having respective conical support faces, stub axle means including cylinder head plugs for compressively engaging said conical support faces, journal pin means secured integrally with said cylinder head plugs to substantially align coaxially with said cylindrical axis and project outwardly from said opposite shell ends, alignment tube means respective to each of said cylinder head plugs having one tube end secured integrally with a respective head plug to project inwardly therefrom along said cylindrical axis, said alignment tube means having distal end joint means to join together the other ends of said tube means with limited, substantially axial, relative displacement freedom, tensible drawbar means positioned axially through said cylinder assembly between oppositely projected journal pin means and tensile adjustment means to compressively load said journal pin means oppositely along the axial length of said shell means against drawbar means tension.

9. A printing cylinder assembly as described by claim 8 wherein said alignment tube means is fabricated of carbon fiber composite material.

10. A printing cylinder assembly as described by claim 8 wherein said distal end joint means comprises the sliding fit union of a pin and a socket, said pin being secured at the other end of one alignment tube means and said socket being secured at the other end of other alignment tube means.

11. A printing cylinder assembly as described by claim 10 wherein said pin includes an axial throughbore for sliding receipt of said tensile drawbar means.

12. A printing cylinder assembly as described by claim 11 wherein said alignment tube means is fabricated of carbon fiber composite material.

13. A printing cylinder assembly having a thin cylindrical shell secured to stub shaft means by end collet means having conical compression faces, the improvement comprising shell end plugs having conical compression faces corresponding to said end collet means, journal pins secured integrally to respective end plugs and extended axially outward therefrom, tubular alignment means having one end thereof secured to respective end plugs and extended axially inward therefrom said journal pins and tubular alignment means in substantially coaxial relative alignment, an opposite end of said tubular alignment means respective to each of said tubular means having axially slidable joint means to substantially coaxially join said tubular means opposite ends, and loading means to compressively preload said journal pins along the mutual coaxis.

14. A printing cylinder assembly as described by claim 13 wherein said tubular alignment means is fabricated of carbon fiber composite material.

15. A printing cylinder assembly as described by claim 13 wherein said axially slidable joint means respective to one of said alignment means comprises a pin element secured at the opposite end of said one alignment means and a slidably mating socket for said pin element secured the opposite end of the other alignment means.

16. A printing cylinder assembly as described by claim 15 wherein said pin element is open along the axis thereof for sliding receipt of a drawbar loading means therethrough.

17. A printing cylinder assembly as described by claim 16 wherein said tubular alignment means is fabricated of carbon fiber composite material.

18. A printing press having rotary image cylinders, at least one of said cylinders comprising an assembly of cylindrical structural shell means, axle stub means and tieing means to axially preload said axle stub means against said shell means in common axial alignment, said axle stub means comprising a pair of head plugs for compressively bearing against opposite ends of said structural shell means, each of said head plugs having journal pins secured thereto and extending longitudinally outward from respective shell ends along said common alignment axis, said head plugs also having respective axial alignment means secured thereto at one end thereof, said axial alignment means extending longitudinally inwardly from respective shell ends and coaxially jointed at respective distal ends with freedom of relative axial displacement.

19. A printing press as described by claim 18 wherein said alignment means is a tube fabricated of carbon fiber composite material.

20. A printing press as described by claim 18 wherein said distal ends of said alignment means from respective head plugs are joined together by the slidingly mated fit of pin and socket elements said pin being secured to one of said distal ends and said socket element being secured to the other of said distal ends.

21. A printing press as described by claim 20 wherein said pin element includes an axial aperture therethrough to slidably receive said tieing means.

22. A printing press as described by claim 20 wherein said alignment means is a tube fabricated of carbon fiber composite means.

* * * * *

UNITED STATES PATENT AND TRADEMARK OFFICE

CERTIFICATE OF CORRECTION

PATENT NO. : 5,490,458

DATED : February 13, 1996

INVENTOR(S) : Warner H. Stuart

It is certified that error appears in the above-indentified patent and that said Letters Patent is hereby corrected as shown below:

Col. 3, line 52, after "40 with a", delete "sealing" and insert --seating--.

Col. 3, line 53, after "bonding base 45 in a", delete "countersunk" and insert --counter--.

Col. 3, line 60, after "A socket liner 44 is securely set in a", delete "countersunk" and insert --counter--.

Signed and Sealed this

Thirtieth Day of July, 1996

*Attest:*

Bruce Lehman

BRUCE LEHMAN

*Attesting Officer*

*Commissioner of Patents and Trademarks*